US009779661B2

(12) United States Patent
Yang

(10) Patent No.: US 9,779,661 B2
(45) Date of Patent: Oct. 3, 2017

(54) PIXEL CIRCUIT AND DISPLAY APPARATUS

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventor: Shengji Yang, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 14/762,317

(22) PCT Filed: Nov. 7, 2014

(86) PCT No.: PCT/CN2014/090620
§ 371 (c)(1),
(2) Date: Jul. 21, 2015

(87) PCT Pub. No.: WO2016/004713
PCT Pub. Date: Jan. 14, 2016

(65) Prior Publication Data

US 2016/0247447 A1 Aug. 25, 2016

(30) Foreign Application Priority Data

Jul. 10, 2014 (CN) ..... 2014 1 0328400

(51) Int. Cl.
*G09G 3/30* (2006.01)
*G09G 3/3233* (2016.01)
*G09G 3/3291* (2016.01)

(52) U.S. Cl.
CPC ..... *G09G 3/3233* (2013.01); *G09G 3/3291* (2013.01); *G09G 2300/043* (2013.01);
(Continued)

(58) Field of Classification Search
CPC ..... G09G 3/3233; G09G 3/3291
See application file for complete search history.

(56) References Cited

U.S. PATENT DOCUMENTS 6,777,886 B1 8/2004 Lo et al.
2006/0221004 A1 10/2006 You et al.
(Continued)

FOREIGN PATENT DOCUMENTS

CN 102708819 A 10/2012
CN 102779834 A 11/2012
(Continued)

OTHER PUBLICATIONS

First Chinese Office Action dated Apr. 28, 2016; Appln. No. 201410328400.5.
(Continued)

*Primary Examiner* — William Boddie
*Assistant Examiner* — Alecia D English
(74) *Attorney, Agent, or Firm* — Ladas & Parry LLP

(57) ABSTRACT

A pixel circuit comprising two sub pixel circuits, each of which includes: five switching units, a driving unit, an energy storage unit and an electroluminescent unit. A first switching unit, a second switching unit and a fifth switching unit of a first sub pixel circuit and a first switching unit, a second switching unit and a fifth switching unit of a second sub pixel circuit share a scanning signal line. In the pixel circuit, the operating current flowing through the electroluminescent unit is not affected by the threshold voltage of the corresponding driving transistor, which solves the problem of non-uniformity of display luminance because of the
(Continued)

threshold voltage drift of the driving transistor. At the same time, driving of two pixels is completed by using one compensation circuit, and the two adjacent pixels share a plurality of signal lines, which can reduce a number of signal lines used for the pixel circuit in the display apparatus, reduce a cost of an integrated circuit, decrease pixel spacing and achieve a higher pixel density.

18 Claims, 7 Drawing Sheets

(52) U.S. Cl.
CPC ..... *G09G 2300/0426* (2013.01); *G09G 2300/0465* (2013.01); *G09G 2300/0819* (2013.01); *G09G 2300/0842* (2013.01); *G09G 2300/0861* (2013.01); *G09G 2310/0202* (2013.01); *G09G 2310/0262* (2013.01); *G09G 2320/043* (2013.01)

(56) References Cited

U.S. PATENT DOCUMENTS

2011/0090202 A1* 4/2011 Han ..... G09G 3/32 345/211
2011/0267319 A1* 11/2011 Han ..... G09G 3/3233 345/204
2013/0088416 A1 4/2013 Smith et al.
2014/0118231 A1* 5/2014 Yang ..... G09G 3/3258 345/82
2014/0118328 A1 5/2014 Guo et al.
2015/0213761 A1 7/2015 Chen
2016/0155383 A1* 6/2016 Chen ..... G09G 3/3233 345/211

FOREIGN PATENT DOCUMENTS

CN 103474024 A 12/2013
CN 103474025 A 12/2013
CN 104091820 A 10/2014
CN 203950535 U 11/2014
KR 1100658631 B1 12/2006
TW 201417073 A 5/2014

OTHER PUBLICATIONS

International Search Report mailed Apr. 16, 2015; PCT/CN2014/090620.

Written Opinion of the International Searching Authority mailed Apr. 16, 2015; PCT/CN2014/090620.

* cited by examiner

PIXEL CIRCUIT AND DISPLAY APPARATUS

TECHNICAL FIELD

The present disclosure relates to a display technique field, in particular, to a pixel circuit and a display apparatus.

BACKGROUND

An organic light emitting display (OLED) is a hot topic in the present flat panel display research field. Compared with a liquid crystal display, OLED has advantages of low power consumption, low production cost, self-luminescent, broad viewing angle, and fast response speed and so on. At present, in the display field of a mobile phone, a PDA and a digital camera and the like, OLED has started to replace a traditional LCD display screen. The pixel driving circuit design is a core technical content of the OLED display, and has important research significance.

Unlike a thin film transistor liquid crystal display (TFT-LCD) that utilizes a stable voltage to control luminance, OLED belongs to a current-driven display and needs a stable current to control light emitting.

Due to process manufacturing and device aging and so on, in the original 2T1C driving circuit (comprising two thin film transistors and one capacitor), the threshold voltage of the driving TFT of respective pixel points has non-uniformity, which results in that the current flowing through OLED of each pixel point changes, so that the display luminance is non-uniform, thereby influencing the display effect of the entire image.

In general, one pixel circuit is corresponding to one pixel, each pixel circuit comprises at least one data voltage line, one operating voltage line and a plurality of scanning signal lines, which results in that the corresponding manufacturing process is relatively complicated and is disadvantageous for decreasing pixel spacing.

SUMMARY

There provides in embodiments of the present disclosure a pixel circuit, comprising two sub pixel circuits;

each sub pixel circuit comprises: a first switching unit, a second switching unit, a third switching unit, a fourth switching unit, a fifth switching unit, a driving unit, an energy storage unit and an electroluminescent unit; and control terminals of the first switching unit and the fifth switching unit are connected to a first scanning signal line; a first terminal of the first switching unit is connected to an operating voltage line, and a second terminal thereof is connected to an input terminal of the driving unit; a first terminal of the fifth switching unit is connected to an output terminal of the driving unit, and a second terminal thereof is connected to the electroluminescent unit;

a first terminal of the second switching unit is connected to the input terminal of the driving unit, and a second terminal thereof is connected to a first terminal of the energy storage unit;

a first terminal of the third switching unit is connected to the output terminal of the driving unit, a second terminal thereof is connected to a data voltage line;

a control terminal of the fourth switching unit is connected to a second scanning signal line, and a first terminal thereof is connected to a control terminal of the driving unit, and a second terminal thereof is grounded;

a first terminal of the energy storage unit is further connected to the control terminal of the driving unit, and a second terminal thereof is connected to the operating voltage line;

wherein control terminals of a second switching unit and a third switching unit of a first sub pixel circuit are connected to a third scanning signal line; control terminals of a second switching unit and a third switching unit of a second sub pixel circuit are connected to a fourth scanning signal line.

Alternatively, the switching units and the driving unit are thin film transistors. Control terminals of respective switching units are gates, first terminals thereof are sources, and second terminals thereof are drains. The input terminal of the driving unit is a source, the control terminal thereof is a gate, and the output terminal thereof is a drain.

Alternatively, the respective thin film transistors are P channel type transistors.

Alternatively, the energy storage unit is a capacitor.

Alternatively, the electroluminescent unit is an organic light emitting diode.

There further provides in the present disclosure a display apparatus, comprising the pixel circuit described above.

Alternatively, two sub pixel circuits of the pixel circuit are located within two adjacent pixels respectively.

Alternatively, the two adjacent pixels are located at two sides of the data voltage line respectively.

Alternatively, the two adjacent pixels are located at a same side of the data voltage line.

In the pixel circuit provided in the embodiments of the present disclosure, the operating current flowing through the electroluminescent unit is not affected by the threshold voltage of the corresponding driving transistor, which thoroughly solves the problem of non-uniformity of display luminance because of the threshold voltage drift of the driving transistor. At the same time, in the embodiments of the present disclosure, driving of two pixels is completed by using one compensation circuit, and the two adjacent pixels share a plurality of signal lines, which can reduce a number of signal lines used for the pixel circuit in the display apparatus, reduce the cost of an integrated circuit, decrease pixel spacing and raise the pixel density.

DETAILED DESCRIPTION

Specific implementations of the present disclosure would be further described below in combination with drawings and embodiments. Following embodiments are only used to explain solutions of the present disclosure more clearly, but should not be considered as to limit a protection scope of the present disclosure.

Figure 1:
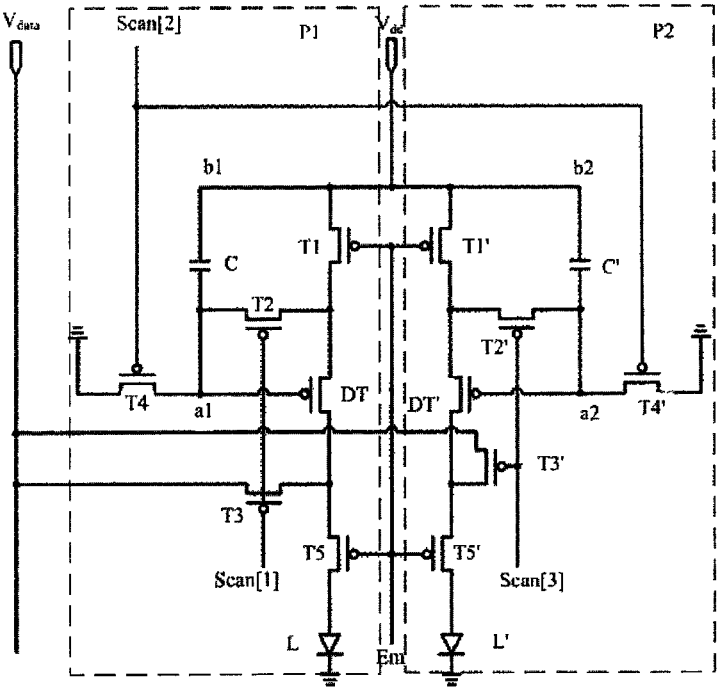
FIG. 1 is a schematic diagram illustrating a structure of a pixel circuit provided in an embodiment of the present disclosure.

FIG. 1 is a schematic diagram illustrating a structure of a pixel circuit provided in an embodiment of the present disclosure. As shown in FIG. 1, the pixel circuit in the embodiment of the present disclosure can comprise: two sub pixel circuits P1 and P2. Herein, each sub pixel circuit is corresponding to one pixel. Each sub pixel circuit comprises: five switching units T1, T2, T3, T4, T5, and one driving unit DT, one energy storage unit C, and one electroluminescent unit L. For a purpose of making a distinction conveniently, in FIG. 1, the five switching units of P2 are represented as T1', T2', T3', T4' and T5', respectively, the driving unit is represented as DT', the energy storage unit is represented as C', and the electroluminescent unit is represented as L', the same below.

Control terminals of the switching units T1 and T5 are all connected to a first scanning signal line Em; a first terminal of T1 is connected to an operating voltage line $V_{dd}$, a second terminal thereof is connected to an input terminal of DT; a first terminal of T5 is connected to an output terminal of DT, and a second terminal thereof is connected to the electroluminescent unit L.

A first terminal of the switching unit T2 is connected to the input terminal of DT, a second terminal thereof is connected to a first terminal a1 of C (for C', its first terminal is a terminal a2 as shown in FIG. 1, and its second terminal is a terminal b2 as shown in FIG. 1).

A first terminal of the switching unit T3 is connected to the output terminal of DT, and a second terminal thereof is connected a data voltage line $V_{data}$.

A control terminal of the switching unit T4 is connected to a second scanning signal line Scan[2], and a first terminal thereof is connected to a control terminal of DT, and a second terminal thereof is grounded.

The first terminal a1 of the energy storage unit C is further connected to the control terminal of DT, and a second terminal b1 thereof is connected to the operating voltage line $V_{dd}$.

Furthermore, control terminals of T2 and T3 of the first sub pixel circuit P1 are connected to a third scanning signal line Scan[1], and control terminals of T2' and T3' of the second sub pixel circuit P2 are connected to a fourth scanning signal line Scan[3].

It shall be understood that in the embodiment of the present disclosure, a plurality of switching units whose control terminals are connected to a same scanning signal line (for example, four switching units T1, T1', T5, T5' connected to Em, two switching units T2, T3 connected to Scan[1], and two switching units T2' and T3' connected to Scan[3]) should be switching units of the same channel type, i.e., all being turned on at a high level or all being turned on at a low level, so as to ensure that the two switching units connected to the same scanning signal line have a same turn-on or turn-off state.

In the pixel circuit provided in the embodiment of the present disclosure, the operating current flowing through the electroluminescent unit is not affected by the threshold voltage of the corresponding driving transistor, which thoroughly solves the problem of non-uniformity of display luminance because of the threshold voltage drift of the driving transistor. At the same time, in the embodiment of the present disclosure, driving of two pixels is completed by using one compensation circuit, which reduces the number of the compensating TFT devices and decreases one data voltage line. Thus, the number of signal lines can be reduced, so that pixel spacing can be decreased greatly and a cost of an IC is also reduced, which can achieve a higher pixel density.

Alternatively, the switching units and the driving unit are thin film transistors TFTs. Control terminals of the respective switching units are gates, first terminals thereof are sources, and second terminals thereof are drains. The input terminal of the driving unit is a source, the control terminal thereof is a gate, and an output terminal thereof is a drain. Of course, the switching units and the driving unit can also be other appropriate devices or a combination of the devices.

Further, in the embodiment of the present disclosure, all the respective thin film transistors are P channel type transistors. By utilizing the same type of transistors, uniformity of processes can be achieved, so that a yield rate of products can be increased. Those skilled in the art can understand that, the types of the respective transistors may be not completely same in the practical application, for example, T1 and T5 may be the N channel type transistors, while T2 and T3 may be the P channel type transistors. As long as two switching elements whose control terminals are connected to the same scanning signal line have a same turn-on/turn-off state, the solutions provided in the present disclosure can be implemented. Alternative implementations of the present disclosure should not be constructed as limitations to the protection scope of the present disclosure.

Alternatively, the energy storage C is a capacitor. Of course, other elements having an energy storing function can also be used according to the design requirements in the actual application.

Alternatively, the electroluminescent unit L can be an organic light emitting diode (OLED). Of course, other elements having an electroluminescent function can also be used according to the design requirements in the actual application.

Figure 2:
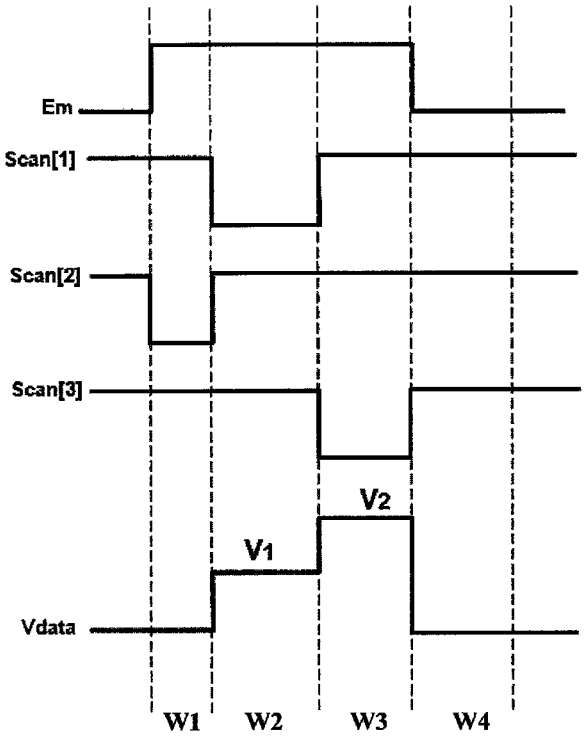
FIG. 2 is a timing diagram of essential signals in the pixel circuit provided in an embodiment of the present disclosure

FIG. 2 is a timing diagram of essential signals in the pixel circuit provided in an embodiment of the present disclosure. FIGS. 3*a*-3*d* are schematic diagrams illustrating current flow directions and voltage values for the pixel circuit under different timings in an embodiment of the present disclosure. Operation principles of the pixel circuit provided in the exemplary embodiment of the present disclosure will be described below in detail by combining with FIGS. 2 and 3. As shown in FIG. 2, the timing of scanning signals input to respective scanning signal lines when the pixel circuit provided in the present disclosure operates can be divided into four phases. The four phases are represented in FIG. 2 as a resetting phase W1, a first discharging phase W2, a second discharging phase W3, and a light emitting phase W3, respectively. In the respective phases, the current flow directions and the voltage values in the pixel circuit are as shown in FIGS. 3*a*, 3*b*, 3*c* and 3*d*, respectively. For a purpose of making it convenient for description, it is assumed that the respective switching units are the P channel type TFTs.

Figure 3A:
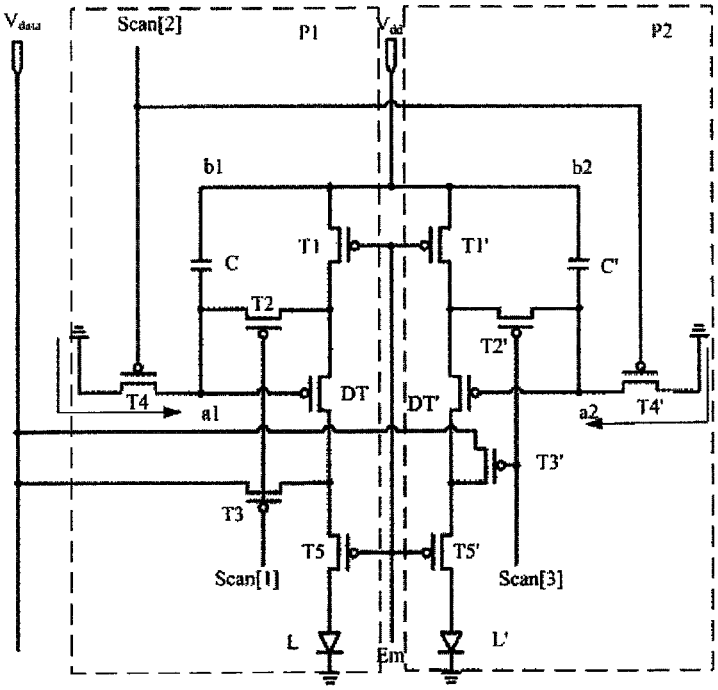
FIGS. 3*a*-3*d* are schematic diagrams illustrating current flow directions and voltage values for the pixel circuit under different timings in an embodiment of the present disclosure.
Figure 3B:
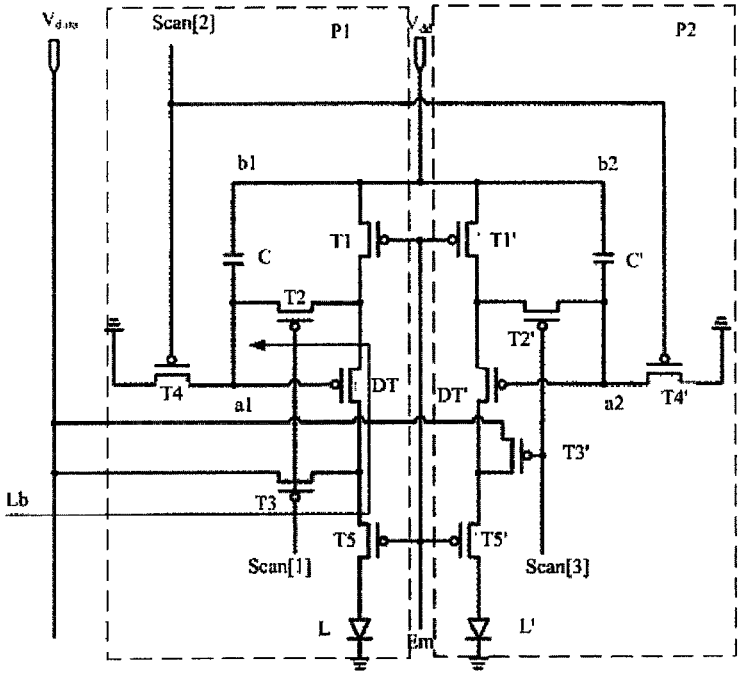
Figure 3C:
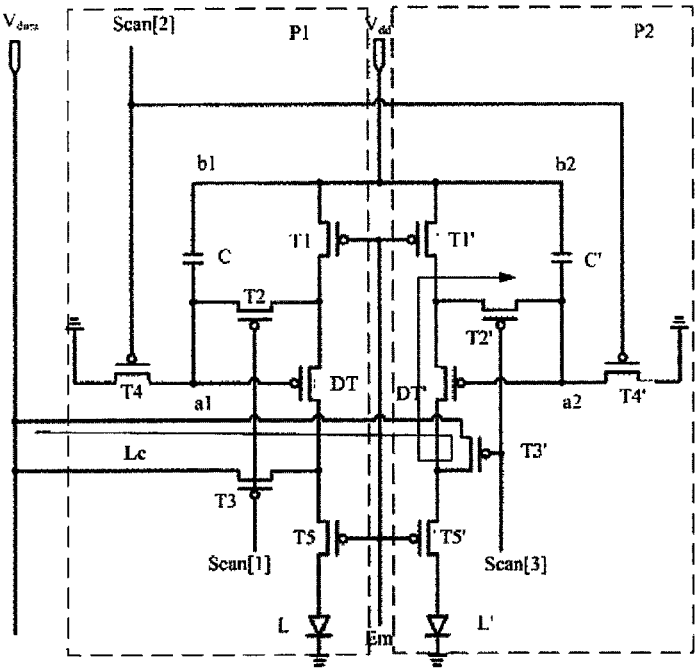
Figure 3D:
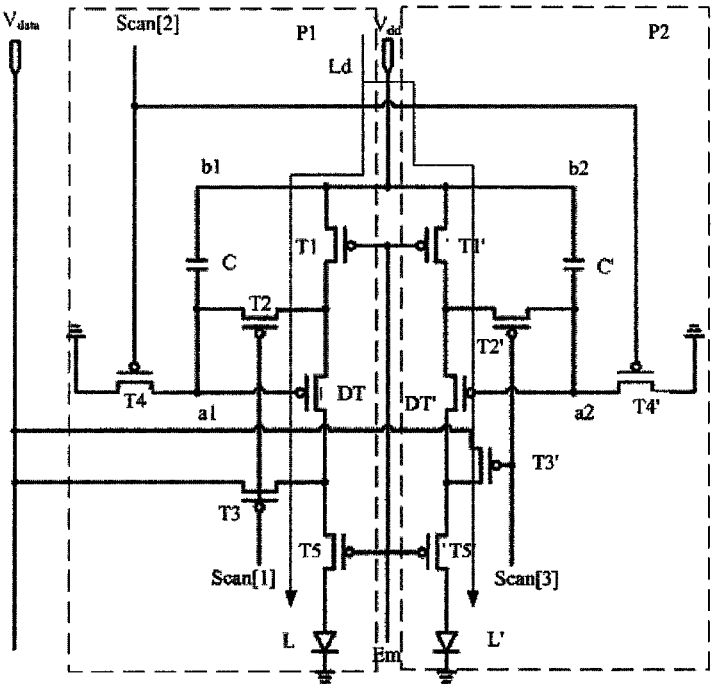

In the resetting phase W1, as shown in FIG. 2, Scan[2] is at a low level, and other scanning signal lines are at a high level. At this time, as shown in FIG. 3*a*, T4 and T4' are turned on, other TFTs are turned off, a node a1 of a capacitor C1 and a node a2 of a capacitor C2 are connected to the ground simultaneously, and a potential at the two nodes is 0V.

In the first discharging phase W2, as shown in FIG. 2, Scan[1] is at the low level, other scanning signal lines are at the high level, and $V_{data}=V_1$, and $V_1$ is a voltage corresponding to the electroluminescent unit L. Now, T2 and T3 are turned on, other TFTs are turned off, and the current flowing direction is as shown in Lb of FIG. 3*b*. After discharging is ended, a potential at the node a1 is $V_1$-$V_{th1}$, a potential at the node b1 is $V_{dd}$, wherein $V_{th1}$ and $V_{th2}$ are threshold voltages of DT and DT' respectively.

In the second discharging phase W3, as shown in FIG. 2, Scan[3] is at the low level, other scanning signal lines are at the high level, and $V_{data}$=$V_2$, and $V_2$ is a voltage corresponding to the electroluminescent unit L'. Now, T2' and T3' are turned on, other TFTs are turned off, and the current flowing direction is as shown in Lc of FIG. 3*c*. After discharging is ended, a potential at the node a2 is $V_2$-$V_{th2}$, a potential at the node b2 is $V_{dd}$.

In the light emitting phase W4, as shown in FIG. 2, in the scanning signal line, Em is at the low level, and other scanning signal lines are at the high level. Now, T1, T1', T5, T5', DT, DT' are turned on, other TFTs are turned off, $V_{dd}$ supplies current to L and L' along Ld in FIG. 3*d*, so that L and L' emit light.

It can be obtained from a saturation current formula that the current flowing through L at this time $I_L=K(V_{GS}-V_{th1})^2=[V_{dd}-(V_1-V_{th1})-V_{th1})]^2=K*(V_{dd}-V_1)^2$.

Likewise, $I_L=K*(V_{dd}-V_2)^2$.

It can be seen from the above formula that the operating current flowing through the two electroluminescent units would not be affected by the threshold voltage of the driving transistor at this time, but is only related to the data voltage $V_{data}$. Thus, the problem of the threshold voltage ($V_{th}$) drift caused by the manufacturing process and long-time operation of the driving transistor TFT is thoroughly solved, its effect on the current flowing through the electroluminescent unit is eliminated, and normal operation of the electroluminescent unit is ensured. At the same time, in the embodiment of the present disclosure, two pixels share the same data voltage line and the same operating voltage line, and only use three scanning signal lines to reduce the number of corresponding signal lines greatly, the cost of an integrated circuit, and decrease pixel spacing thereby raising pixel density.

Based on the same concept, there further provides in an embodiment of the present disclosure a display apparatus, comprising the pixel circuit described above.

Alternatively, in the display apparatus, two sub pixel circuits of the pixel circuit are located within two adjacent pixels respectively. In this way, it can make elements and devices are distributed on a corresponding substrate more uniformly.

Figure 4:
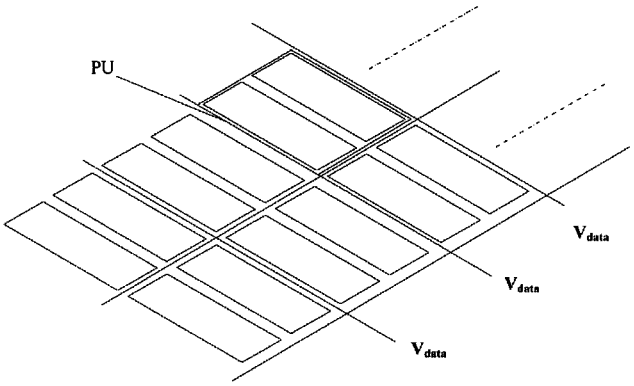
FIG. 4 is a schematic diagram illustrating a position relationship between the pixel circuits and pixels in a display apparatus provided in an embodiment of the present disclosure.

FIG. 4 is a schematic diagram illustrating a position relationship between the pixel circuits and pixels in a display apparatus provided in an embodiment of the present disclosure. Alternatively, the above two adjacent pixels can be located at a same side of their data voltage lines. FIG. 4 shows the situation that two adjacent pixels corresponding to one pixel circuit PU are located at one side of their corresponding data voltage line $V_{data}$.

Figure 5:
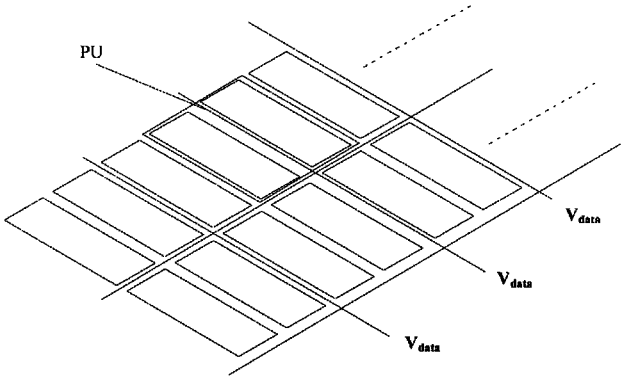
FIG. 5 is a schematic diagram illustrating another position relationship between the pixel circuits and pixels in a display apparatus provided in an embodiment of the present disclosure.

FIG. 5 is a schematic diagram illustrating another position relationship between the pixel circuits and pixels in a display apparatus provided in an embodiment of the present disclosure. Alternatively, the above two adjacent pixels can be located at two sides of their data voltage lines. FIG. 5 shows the situation that two adjacent pixels corresponding to one pixel circuit PU are located at two sides of their corresponding data voltage line $V_{data}$.

The display apparatus can be any product or means having a display function such as an electronic page, a mobile phone, a tablet computer, a television, a display, a notebook computer, a digital photo frame and a navigator and the like.

The above descriptions are just alternatively exemplary embodiments of the present disclosure. It shall be pointed out that various improvements and modifications can be made without departing from the principle of the present disclosure for those skilled in the art and these improvements and modifications shall be deemed as falling into the protection scope of the present disclosure.

The present application claims the priority of a Chinese patent application No. 201410328400.5 filed on Jul. 10, 2014. Herein, the content disclosed by the Chinese patent application is incorporated in full by reference as a part of the present disclosure.

What is claimed is:

1. A pixel circuit, comprising two sub pixel circuits, wherein each sub pixel circuit comprises: a first switching unit, a second switching unit, a third switching unit, a fourth switching unit, a fifth switching unit, a driving unit, an energy storage unit and an electroluminescent unit;

control terminals of the first switching unit and the fifth switching unit are connected to a first scanning signal line; a first terminal of the first switching unit is connected to an operating voltage line, and a second terminal thereof is connected directly to an input terminal of the driving unit; a first terminal of the fifth switching unit is connected directly to an output terminal of the driving unit, and a second terminal thereof is connected directly to the electroluminescent unit;

a first terminal of the second switching unit is connected directly to the input terminal of the driving unit, and a second terminal thereof is connected directly to a first terminal of the energy storage unit;

a first terminal of the third switching unit is connected directly to the output terminal of the driving unit, a second terminal thereof is connected directly to a data voltage line;

a control terminal of the fourth switching unit is connected to a second scanning signal line, and a first terminal thereof is connected directly to a control terminal of the driving unit, and a second terminal thereof is grounded; and a first terminal of the energy storage unit is further connected to the control terminal of the driving unit, and a second terminal thereof connected to the operating voltage line;

wherein control terminals of a second switching unit and a third switching unit of a first sub pixel circuit are connected directly to a third scanning signal line; control terminals of a second switching unit and a third switching unit of a second sub pixel circuit are connected directly to a fourth scanning signal line.

2. The pixel circuit according to claim 1, wherein the switching unit and the driving unit are thin film transistors, control terminals of respective switching units are gates, first terminals thereof are sources, and second terminals thereof are drains, and the input terminal of the driving unit is a source, the control terminal thereof is a gate, and the output terminal thereof is a drain.

3. The pixel circuit according to claim 2, wherein the respective thin film transistors are P channel type transistors.

4. The pixel circuit according to claim 1, wherein the energy storage unit is a capacitor.

5. The pixel circuit according to claim 1, wherein the electroluminescent unit is an organic light emitting diode.

6. A display apparatus, comprising the pixel circuit according to any claim 1.

7. The display apparatus according to claim 6, wherein two sub pixel circuits of the pixel circuit are located within two adjacent pixels respectively.

8. The display apparatus according to claim 7, wherein the two adjacent pixels are located at two sides of the data voltage line respectively.

9. The display apparatus according to claim 7, wherein the two adjacent pixels are located at the same side of the data voltage line.

10. The pixel circuit according to claim 2, wherein the energy storage unit is a capacitor.

11. The pixel circuit according to claim 3, wherein the energy storage unit is a capacitor.

12. The pixel circuit according to claim 2, wherein the electroluminescent unit is an organic light emitting diode.

13. The pixel circuit according to claim 3, wherein the electroluminescent unit is an organic light emitting diode.

14. The pixel circuit according to claim 4, wherein the electroluminescent unit is an organic light emitting diode.

15. The display apparatus according to claim 6, wherein the switching unit and the driving unit are thin film transistors, control terminals of respective switching units are gates, first terminals thereof are sources, and second terminals thereof are drains, and the input terminal of the driving unit is a source, the control terminal thereof is a gate, and the output terminal thereof is a drain.

16. The display apparatus according to claim 15, wherein the respective thin film transistors are P channel type transistors.

17. The display apparatus according to claim 6, wherein the energy storage unit is a capacitor.

18. The display apparatus according to claim 6, wherein the electroluminescent unit is an organic light emitting diode.

* * * * *